US005992785A

United States Patent [19]

Grenz

[11] Patent Number: 5,992,785

[45] Date of Patent: Nov. 30, 1999

[54] REEL WITH A DEVICE FOR COLLECTING WINDINGS HANGING FROM A ROLLING STOCK COIL

[75] Inventor: Günter Grenz, Meerbusch, Germany

[73] Assignee: SMS Schloemann-Siemag Aktiengesellschaft 40237, Düssenldorf, Germany

[21] Appl. No.: 08/966,204

[22] Filed: Nov. 7, 1997

[30] Foreign Application Priority Data

Nov. 14, 1996 [DE] Germany ..... 196 47 029

[51] Int. Cl.[6] ..... B21C 47/24

[52] U.S. Cl. ..... 242/363

[58] Field of Search ..... 242/361.3, 361.5, 242/362.2, 362.3, 363

[56] References Cited

U.S. PATENT DOCUMENTS

| | | |
|---|---|---|
| 3,327,368 | 6/1967 | Russo et al. . |
| 4,411,394 | 10/1983 | Starvaski et al. . |
| 4,869,437 | 9/1989 | Berz et al. . |
| 4,869,438 | 9/1989 | Braun et al. . |
| 5,634,607 | 6/1997 | Poloni . |

FOREIGN PATENT DOCUMENTS

| | | | |
|---|---|---|---|
| 1142332 | 1/1963 | Germany | 242/362.2 |
| 1235100 | 2/1967 | Germany | 242/363 |
| 2453834 | 6/1975 | Germany | 242/361.3 |
| 3723461 | 1/1989 | Germany . | |
| 4213459 | 10/1993 | Germany . | |

*Primary Examiner*—Donald P. Walsh
*Assistant Examiner*—William A. Rivera
*Attorney, Agent, or Firm*—Friedrich Kueffner

[57] ABSTRACT

A reel for round rolling stock, such as fine steel or medium steel, particularly wire, with a coil basket for the wire coil to be coiled and vertically extending guide pins for the wire arranged in the coil basket, and with a raisable and lowerable coil floor which can be actuated by a lifting rod. A device for collecting wire windings hanging from the wire coil is arranged in the area of the upper reel head. The collecting device may be of annular construction and the outer diameter of the annular collecting device essentially corresponds to the outer diameter of the reel and the inner diameter of the annular collecting device corresponds essentially to the outer diameter of the outer surface of the coil basket.

7 Claims, 6 Drawing Sheets

REEL WITH A DEVICE FOR COLLECTING WINDINGS HANGING FROM A ROLLING STOCK COIL

BACKGROUND OF THE INVENTION

1. Field of the Invention

The present invention relates to a reel for round rolling stock, such as fine steel or medium steel, particularly wire, with a coil basket for the wire coil to be coiled and vertically extending guide pins for the wire arranged in the coil basket, and with a raisable and lowerable coil floor which can be actuated by a lifting rod.

2. Description of the Related Art

Rolling trains for wire, fine steel or medium steel are composed of a plurality of high-quality plant components. A single-line or multiple-line wire train is composed, for example, of a support grate for the rolling material being used, usually in the form of billets, and a furnace in which the billets are heated to rolling temperature. The billets are conveyed from the furnace into a breaking-down train which is composed of several roll stands in which a twist-free rolling is made possible. The intermediate train following the breaking-down train also is composed of several roll stands, for example, compact stands, which make it possible to use rolling rings with long service lives. The intermediate train is followed by a finishing train which may be composed of a ten-stand finishing block which is designed for high rolling speeds of up to 90 m/sec and above. Aside from the first two stands of the breaking-down train in which box grooves are used, the rolling stock is exclusively shaped in oval grooves and round grooves. Following the wire train, the rolled wire is cooled. The rolling stock which has been rolled into a round cross-section is coiled into coils in Garrett reels. The rolling stock coils are conveyed from the reel to a transport unit and from there onto a hook conveyor on which further cooling of the rolling stock takes place. Subsequently, the rolling stock coils are shipped.

Among the high-quality plant components of the wire train, as mentioned above, are the wire reel and the means for transporting the coiled wire coil arranged following the wire reel. The reel and the coil transporting means must not impair the continuous manufacturing process of wire and must not cause any damage to the wire surfaces.

A wire reel with an output device for the reeled rolling stock coil is disclosed in DE 37 23 461 A1. The wire reel includes a coil lifting plate which can be raised and lowered in the direction of the center axis of the reel basket by means of a central lifting rod. The rolling stock coiled into a coil is lifted by means of the coil lifting plate until it can be removed from the reel basket.

DE 42 13 459 A1 discloses a device for removing rolling stock coiled into coils, particularly wire, from a reel end for transferring the rolling stock coils to subsequently arranged transport devices. It is proposed that the output and transfer device is provided with a carrousel-type support pallet for the coiled rolling stock coils which can be raised and lowered and displaced horizontally. In addition, one or more reels or one more transport devices are arranged in the peripheral area of displacement of the support pallet. When a coiled wire coil is lifted out of the reel and the coil floor is positioned in the upper reel head, support arms of the transport device are inserted into the longitudinal grooves of the coil floor and are moved underneath the wire coil as a result. For transporting the wire coil, the support arms are lifted, so that the wire coil rests on the support arms. The wire coil resting on the support arms of the transport device is transported from the reel to a transfer device.

When the coiled wire coil is transferred from the reel to the support arms of the transport device, it was not always possible to prevent the last one to two windings of the wire coil from sliding downwardly in irregular intervals. When the support arms of the transport device were inserted in the longitudinal grooves or slots of the coil floor, problems occurred because the end of the windings which were hanging down ended up in front of the open slots of the coil floor.

In the enclosed FIGS. 2, 3 and 4 of the drawing, designated as prior art, this disadvantageous situation is illustrated. In this situation, before the support arms can be inserted into the slots of the coil floor, it was necessary that the operating personnel had to carry out a manual operation. The operator had to lift the wire end with tongs in order to make it possible that the support arms could be inserted into the slots. It was possible only in this manner to ensure a continuous and problem-free transfer of the coiled wire coil from the reel to the transport device. If the operator did not act in this manner, the devices involved in the operation would be damaged, as is clear particularly from FIG. 4. This is because, when the wire end comes to rest in front of one the slots of the coil floor and the support arms of the transport device are inserted into the slots, the wire end is being bent into the slot of the support floor. It is apparent that the bent end of the wire made it impossible to insert the support arms which resulted in damage and required significant manipulations by the operator in order to move the end of the wire from the slot of the coil floor.

SUMMARY OF THE INVENTION

Therefore, it is the primary object of the present invention to improve a reel of the above-described type in such a way that

- a problem-free transfer of a coiled wire coil from a reel by means of a walking beam transport device is possible;
- damage of the walking beam transport device, particularly of the walking beam itself and the coiling unit or reel, are avoided;
- blockage of a slot in the coil floor after removing the wire coil from the actual coiling device or reel is avoided; and
- bending of the wire ends by the walking beam inserted into the coil floor is prevented.

In accordance with the present invention, a device for collecting wire windings hanging from the wire coil is arranged in the area of the upper reel head.

As a result of the configuration according to the present invention, wire windings hanging from the wire coil are collected in a position above the slots in the coil floor, so that the openings of the slots cannot be blocked by the wire ends. Consequently, the walking beam can be inserted without problems and without any damage to the devices involved in the operation. In particular, bending of the end of the wire into the slots of the coil floor is prevented, which, in the past, resulted in particularly disadvantageous problems during the coil transport, for example, the wire coils overturned.

In accordance with a further development of the invention, the collecting device is of annular construction and the outer diameter of the annular collecting device essentially corresponds to the outer diameter of the reel and the inner diameter of the annular collecting device corresponds essentially to the outer diameter of the outer surface of the coil basket. In this configuration of the collecting device, lifting of the finished wire coil out of the reel from the lower coil floor position to the upper coil floor position is not impaired; all typical structural elements of a wire reel are maintained.

It has been found advantageous to provide the upper side of the annular collecting device with a profiled support surface for securely holding any coil ends hanging from the finished wire coil. The support surface may be profiled, for example, in the form of annular grooves in which the wire ends which have dropped down rest in a secured manner with respect to their position.

In accordance with a particularly advantageous further development of the invention, the plane extending over the upper side of the annular collecting device leaves open the slots in the coil floor when the coil floor is in the lifted position thereof. In accordance with another development of the invention, the slots in the coil floor have a greater cross-section than the cross-section of the walking beam of an output device, not shown, and the cross-sectional shapes of the coil floor slots and of the walking beams correspond essentially to each other.

In accordance with another further development of the reel according to the present invention, the annular collecting device is a separate structural component which can, however, be connected to the upper reel head. This feature makes it possible to retrofit the reel in order to adapt it to the respective rolling stock, for example, to mount the annular collecting device in those cases when the operator observes that a wire quality is being coiled in which the last windings of the wire coil have the tendency to drop down.

In accordance with another development, it may also be provided hat the annular collecting device is a fixed component of the upper reel head, so that, independently of the wire qualities, any wire ends which are hanging down cannot cause interruptions of the operation.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
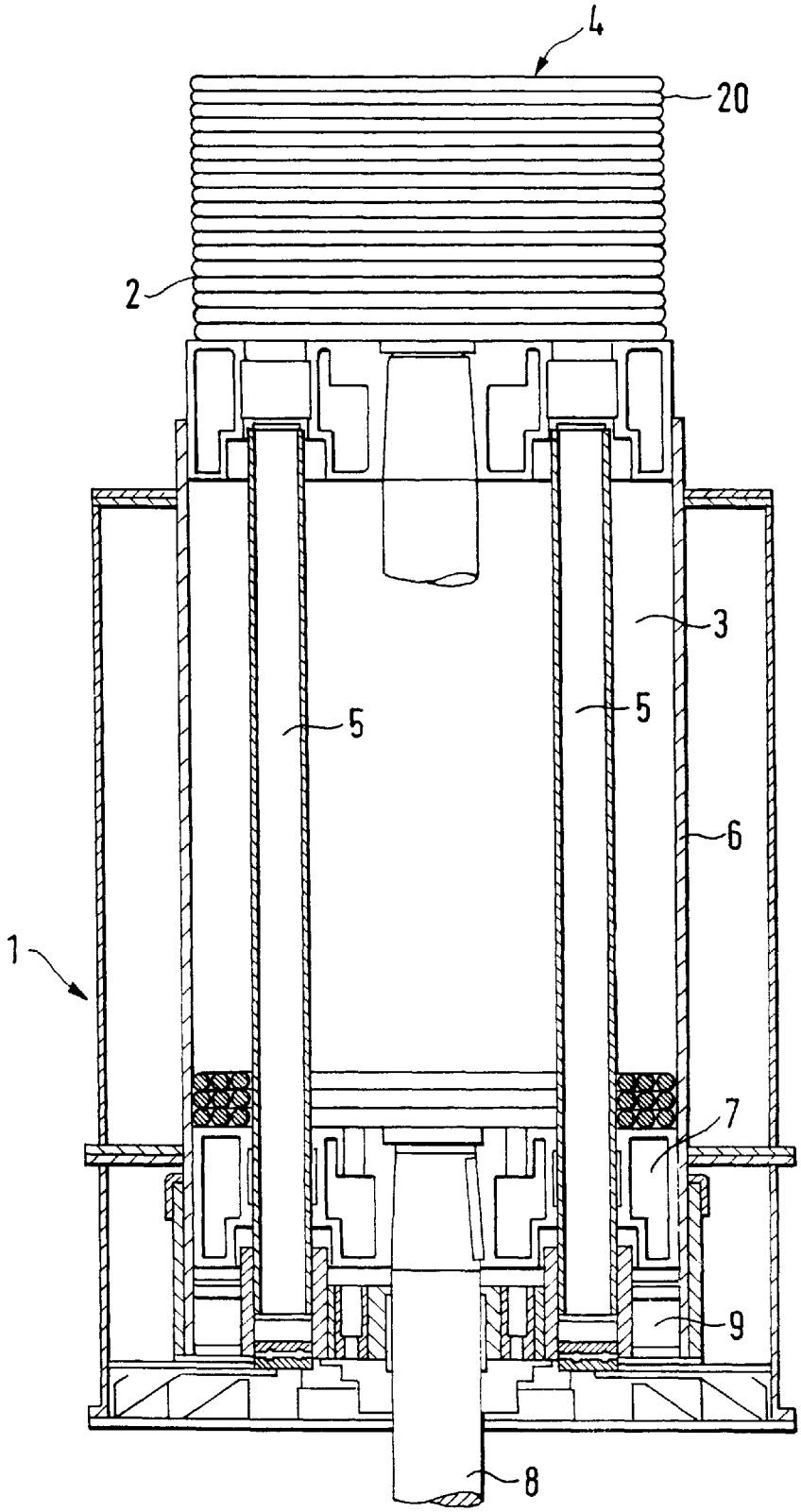
FIG. 1 PRIOR ART
FIGS. 1 and 2 are schematic sectional views of a revolving basket reel in accordance with the prior art, with the coil floor being shown in a lower position and an upper position, respectively.
Figure 2:
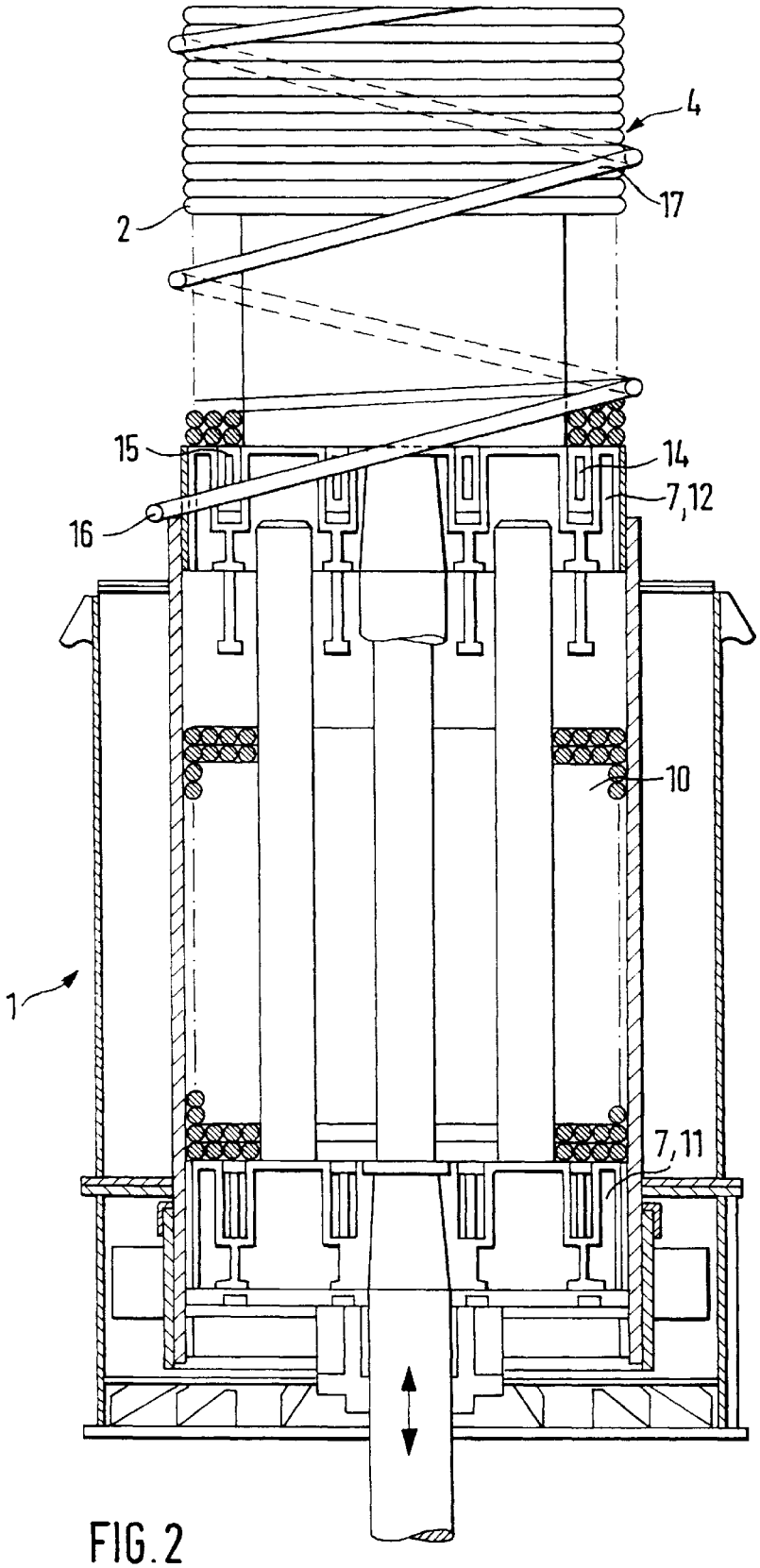
FIG. 2 PRIOR ART
Figure 3A:
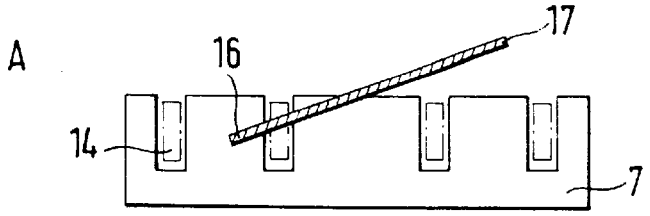
FIG. 3A PRIOR ART
FIG. 3A is a side view and FIG. 3B is a top view of the coil floor of the revolving basket reel with a wire end blocking the slots in the coil floor.
Figure 3B:
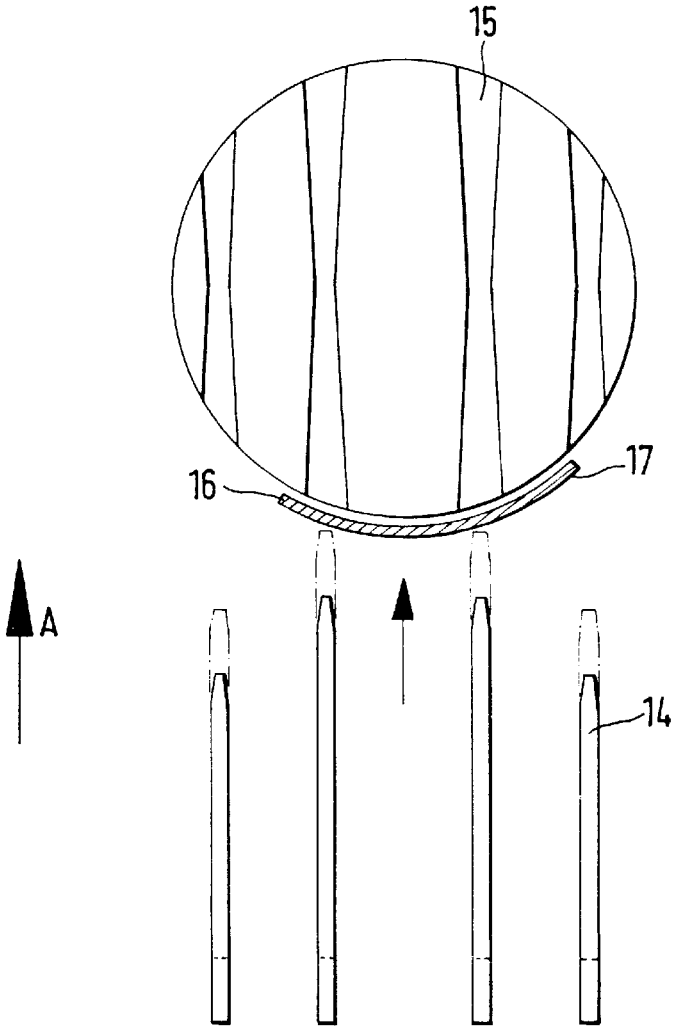
FIG. 3B PRIOR ART
Figure 6:
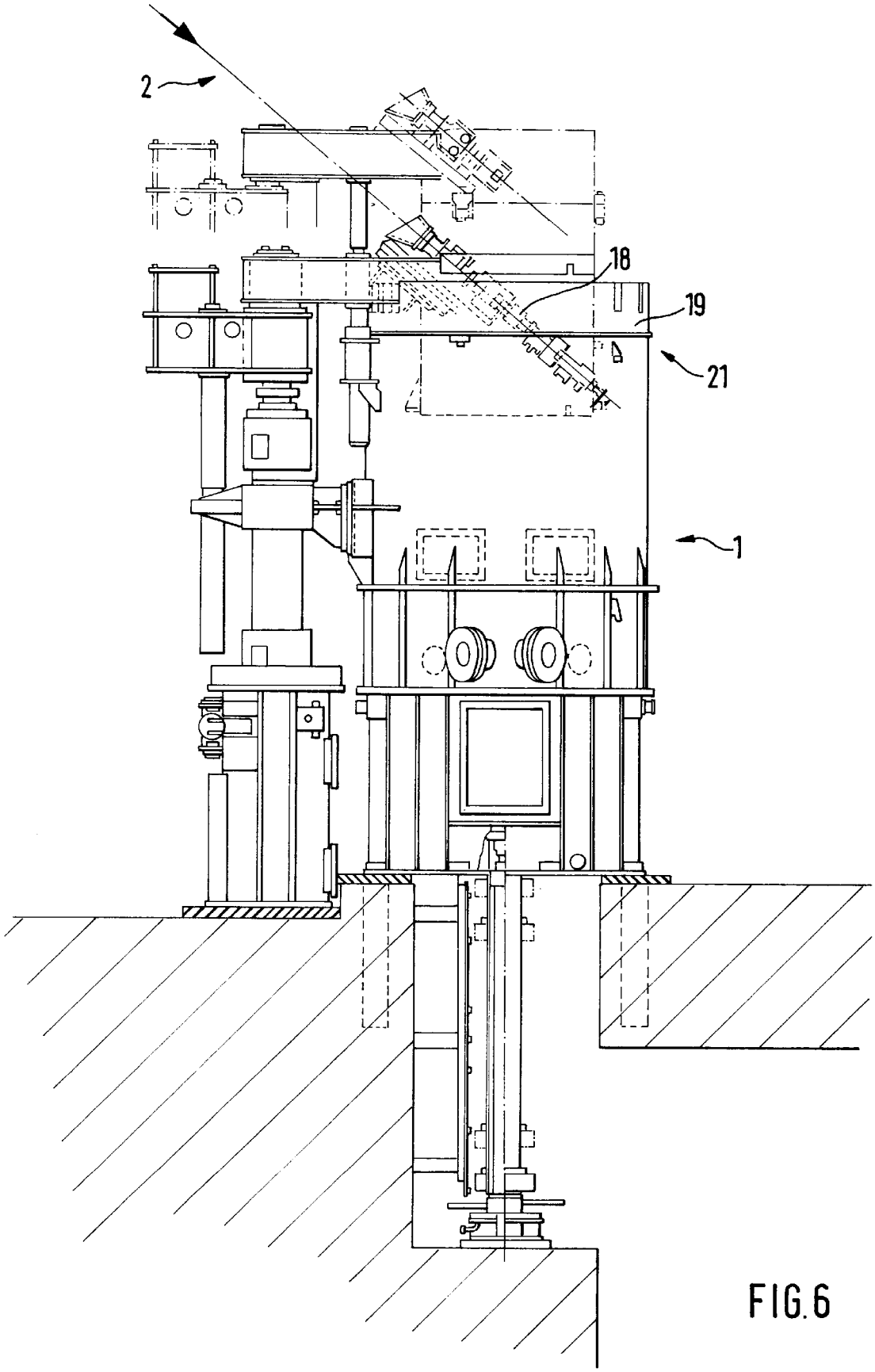
FIG. 6 is an overall illustration of the revolving basket reel according to the present invention with the collecting device for wire windings in the area of the upper reel head and with a tube for placing the wire windings.

FIGS. 1 and 2 of the drawing show a conventional revolving basket reel 1 (Garret reel) for wire 2. The revolving basket reel 1 includes a coil basket 3 composed of the inner guide pins 5 for the wire, the outer basket surface 6, the coil floor 7 with the central lifting rod 8 and the pin support member 9. After a coil 10 has been formed in the coil basked by supplying the rolled wire by means of the tube 18, as seen in FIG. 6, the coil floor 7 is moved upwardly from its lower position 11 by means of a suitable lifting device into an upper position 12 for removing the coil and for transferring the now finished wire coil 4 to an output or transfer device (output system), not shown.

The walking beams 14 of the output system project into the slots 15 of the coil floor 7 positioned in its upper position. The coil floor 7 is then lowered in the revolving basket reel and transfers in this manner the wire coil 4 to the walking beams 14 of the output system for transporting the wire coil away. The formation of rings and the stability of the finished wire coil are significantly influenced by the dimensions (cross-section) of the wire, the wire quality, wire speed and temperature as well as the arrangement of the units participating in the coiling procedure, for example, guide means, drivers, rod ends, brake, placing tube systems, etc., and by the electric control of the aforementioned units.

Figure 4A:
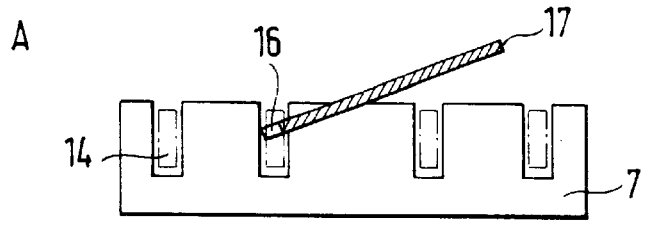
FIG. 4A PRIOR ART
FIG. 4*a* is a side view and FIG. 4B is a top view of the coil floor of the revolving basket reel with a wire end bent into the slots of the coil floor.
Figure 4B:
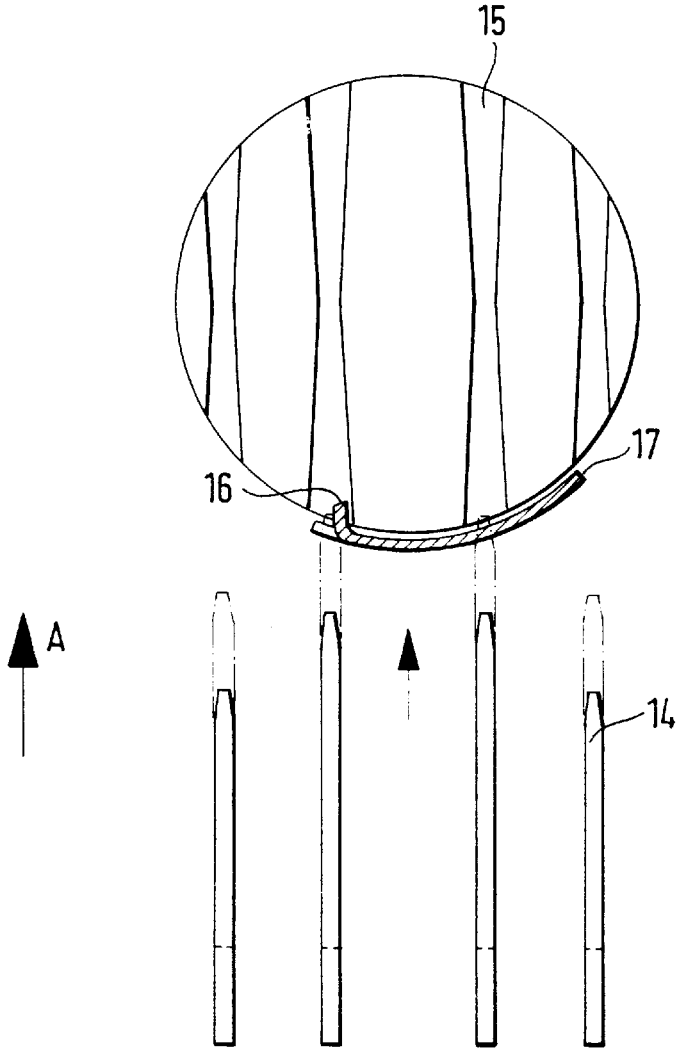
FIG. 4B PRIOR ART

Even when the various devices are adjusted and used in an optimum manner, it cannot always be prevented that the last one or two windings 20 slide downwardly at the outer surface of the wire coil 4 in irregular intervals or spacings. When inserting the walking beams 14 of the output system into the slots 15 in the coil floor 7, problems occur which result from the fact that the wire end 16 of windings 17 which hang down come to rest in front of the open slots 15 of the coil floor 7. This is illustrated in FIG. 2, and particularly in FIGS. 3A, 3B and 4A 4B. FIG.4B shows that a wire end 16 of the windings 17 of the wire coil 4 has been bent as the walking beams 14 of the output system have been inserted into the slots 15 of the coil floor 7. This bending of the wire end prevents the insertion of the walking beams 14 into the slots 15 and the devices participating in the operation are damaged. The revolving basket reel and the output system must be stopped, so that the operator can remove the bent end of the rolling stock out of the slots 15 of the coil floor 7.

Figure 5:
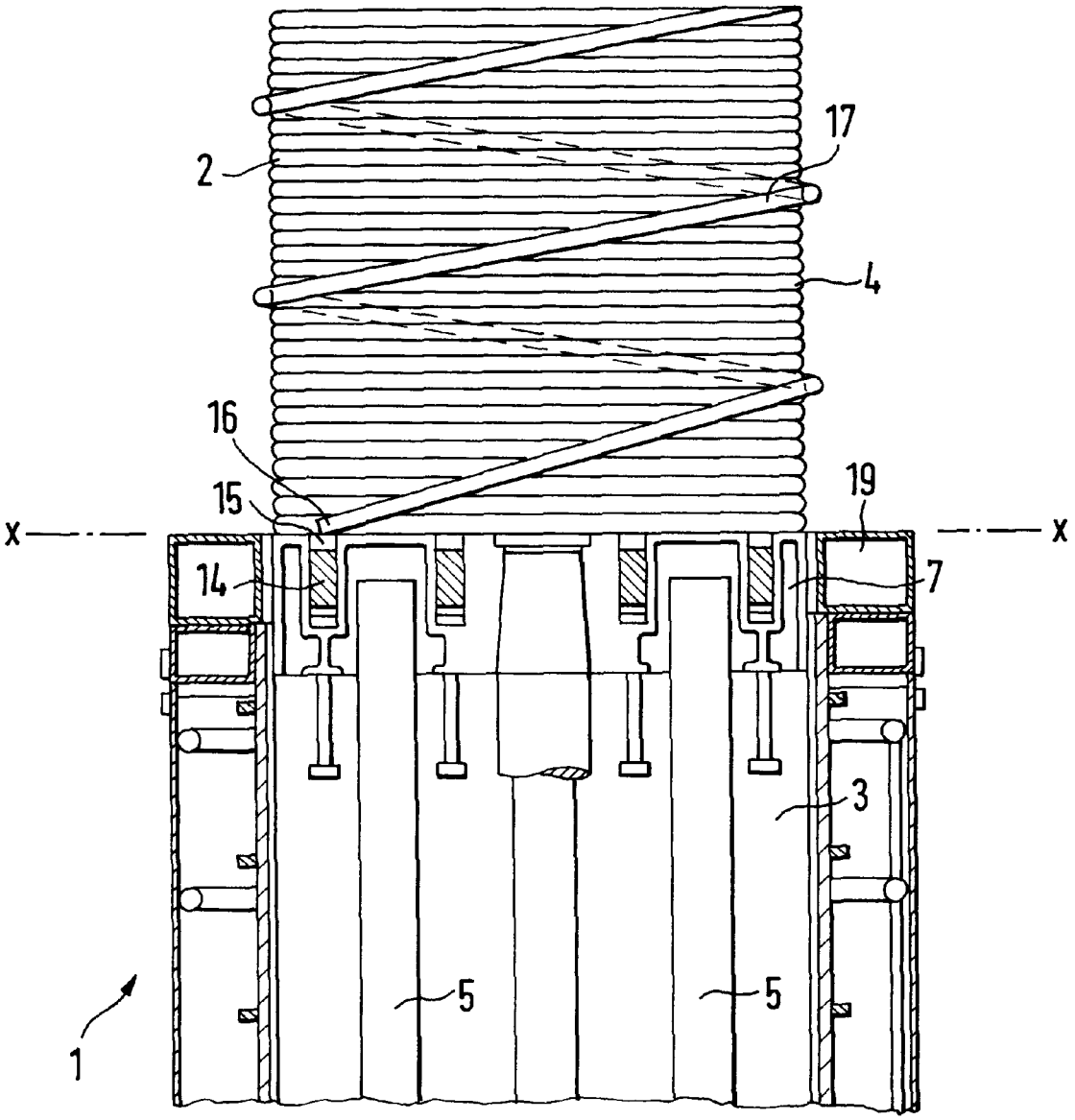
FIG. 5 is a sectional view showing the revolving reel according to the present invention with a device for collecting wire windings in the area of the upper reel head.

The above-described problem is solved by the device shown in FIG. 5. FIG. 5 shows a revolving basket reel 1 for the wire 2 with the collecting device 19 according to the present invention in the reel head area 21, wherein the structural components of the reel 1 are guide pins 5 for the wire, a coil basket 3, a coil floor 7 shown in the raised position, and with inserted walking beams 14 of the output system; also shown is a finished wire coil 4 to be transferred to the output system, wherein the wire coil 4 has windings 17 which hang down. Also shown is the annular collecting device 19 for the wire ends 16.

The outer diameter of the annular collecting device 19 corresponds essentially to the outer diameter of the reel 1 and the inner diameter of the annular collecting device 19 corresponds essentially to the outer diameter of the outer surface 6 of the coil basket 3. The collecting device 19 may have on its upper side a profiled support surface with grooves, not shown in detail, for securely holding winding ends 17 which hang down from the finished wire coil 4. To provide a simple structural configuration, the collecting device 19 is constructed as a hollow annular body. In order to ensure that the slots 15 in the coil floor 7 remain free for the walking beams of the output system, the plane x-x extending over the upper side of the collecting device is arranged above the slots in the coil floor.

As shown in FIG. 5, the annular collecting device 19 is a fixed component of the upper reel head 21. In accordance with another embodiment, however, the annular collecting device 19 may also be a separate component which can be connected to the upper reel head 21. The slots 15 in the coil floor 7 should always have a greater cross-section than the cross-section of the walking beams 14. The shapes of the coil floor slots and of the walking beams should correspond approximately to each other.

FIGS. 6 of the drawing shows an overall view of the revolving basket reel 1 with the collecting device 19 according to the present invention in the area of the reel head. FIG. 6 further shows the arrangement of the tube 18 for placing the rolled wire. It is apparent that the collecting device 19 according to the present invention in the area of the reel head does not require significant structural changes of the revolving basket reel.

The collecting device according to the present invention meets the above-described object in a surprisingly simple manner.

While specific embodiments of the invention have been shown and described in detail to illustrate the inventive principles, it will be understood that the invention may be embodied otherwise without departing from such principles.

I claim:

1. A reel for round rolling stock, such as fine steel, medium steel, or wire, the reel having an upper reel head, the reel comprising a coil basket for a wire coil to be coiled, vertically extending guide pins for the wire arranged in the coil basket, a raisable and lowerable coil floor and a lifting rod for actuating the coil floor, the coil floor having slots adapted to receive support arms of a wire coil transport device, the reel further comprising a device for collecting wire windings hanging from the wire coil, the collecting device being arranged in an area of the upper reel head, wherein the collecting device is an annular collecting device, and wherein the annular collecting device comprises on an upper side thereof a support surface for the wire windings hanging from the wire coil.

2. The reel according to claim 1, wherein an outer diameter of the annular collecting device corresponds to an outer diameter of the reel and an inner diameter of the annular collecting device corresponds to an outer diameter of the coil basket.

3. The reel according to claim 2, wherein support surfaces of the annular collecting device is profiled for securely holding ends of the wire windings hanging from the wire coil.

4. The reel according to claim 2, wherein the annular collecting device is comprised of an annular hollow body.

5. The reel according to claim 4, further comprising an output system for removing the wire coils, the output system comprising walking beams, the walking beams having a cross-section, the slots in the coil floor having a cross-section which is greater than the cross-section of the walking beams, and wherein the slots of the coil floor and the walking beams have cross-sectional shapes which correspond essentially to each other.

6. The reel according to claim 2, wherein the annular collecting device is a structural component which is separate from the upper reel head but configured to be connectable to the upper reel head.

7. The reel according to claim 2, wherein the annular collecting device is a fixed component of the upper reel head.

* * * * *